US006845756B2

(12) United States Patent
Ruthardt et al.

(10) Patent No.: US 6,845,756 B2
(45) Date of Patent: Jan. 25, 2005

(54) HIGH-PRESSURE SEALING ELEMENT TO FOUR INJECTORS

(75) Inventors: Siegfried Ruthardt, Altdorf (DE); Tibor Bauer, Kornwestheim (DE); Wofgang Ballerstedt, Schoenebeck (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/333,357

(22) PCT Filed: May 21, 2002

(86) PCT No.: PCT/DE02/01841

§ 371 (c)(1),
(2), (4) Date: Aug. 8, 2003

(87) PCT Pub. No.: WO02/095217

PCT Pub. Date: Nov. 28, 2002

(65) Prior Publication Data

US 2004/0021011 A1 Feb. 5, 2004

(30) Foreign Application Priority Data

May 21, 2001 (DE) ..... 101 24 602
May 7, 2002 (DE) ..... 102 20 457

(51) Int. Cl.[7] ..... F02M 41/00
(52) U.S. Cl. ..... 123/467; 239/533.8

(58) Field of Search ..... 123/467, 445; 239/533.8, 533.11; 251/129.01, 129.15

(56) References Cited

U.S. PATENT DOCUMENTS 5,067,658 A * 11/1991 De Matthaeis et al. ..... 239/124
5,246,165 A * 9/1993 De Matthaeis et al. ..... 239/96
6,059,205 A * 5/2000 Ricco ..... 239/585.1

FOREIGN PATENT DOCUMENTS

DE EP0483770 * 5/1992
GB EP0890729 * 1/1999
WO WO9937909 * 7/1999

* cited by examiner

*Primary Examiner*—Mahmoud Gimie
(74) *Attorney, Agent, or Firm*—Ronald E. Greigg

(57) ABSTRACT

An injector for injecting fuel into the combustion chamber of an internal combustion engine includes an injector housing, in which a pressure chamber surrounds an insert part. The pressure chamber can be filled with fuel at high pressure via a high-pressure inlet. Via the pressure chamber, a control chamber defined by the insert part and a valve component is subjected to pressure. The valve component is movable inside the insert part, thus executing a stroke motion. A one-piece, metal sealing element is received by a nonpositive connection on the circumference of the insert part is subjected to the high pressure prevailing in the pressure chamber.

13 Claims, 2 Drawing Sheets

HIGH-PRESSURE SEALING ELEMENT TO FOUR INJECTORS

CROSS-REFERENCE TO RELATED APPLICATIONS

This application is a 35 USC 371 application of PCT/DE 02/01841 filed on May 21, 2002.

BACKGROUND OF THE INVENTION

1. Field of the Invention

In fuel injection systems for air-compression internal combustion engines, injection systems with a common rail are presently used. These fuel injection systems also include injectors for injecting fuel into the combustion chambers of the engine, and in terms of tightness and material strength these must withstand the pressures prevailing in the fuel injection system. To that end, annular sealing elements are used on injectors, with which sealing off of the high-pressure region of the injector from regions of low pressure of the injector is performed. If the pressure level in fuel injection systems is raised for the sake of greater thermodynamic efficiency of the engine, then the demands made of the sealing elements of the fuel injector also become more stringent.

2. Prior Art

German Patent Disclosure DE 196 19 523 A1 relates to a fuel injection valve for high-pressure injection. In this embodiment, a fuel injection valve is proposed that is used for high-pressure injection in self-igniting internal combustion engines and for controlling the injection includes a magnet valve. For triggering this magnet valve, a control circuit is provided that is divided up into a first circuit part and a second circuit part. The second circuit part is disposed separately on each individual injection valve from the first circuit part, which first circuit part serves to control a plurality of injection valves in common. The housing is clipped onto the fuel injection valve and experiences a flow of fuel through its interior for the sake of cooling.

In this embodiment, a sealing ring of bronze-reinforced teflon and a metal support ring are let in between the housing and an insert part let into the housing below the control chamber, the support ring of metal material being required in order to improve the sealing action of the bronze-reinforced teflon ring and to prevent the extrusion of the bronze-reinforced teflon ring. To prevent the sealing ring on the insert part from creeping in the direction of the outlet throttle that pressure-relieves the control chamber, suitable measures must be taken. Moreover, in the embodiment until now, with the use of the bronze-reinforced teflon ring and the metal support ring, it is necessary that these rings be mounted at the correct position by a secure process, which necessitates considerable effort and expense in production.

SUMMARY OF THE INVENTION

With the embodiment according to the invention, compared to the version known from the prior art, on the one hand a savings is achieved by omitting one structural part, and on the other, the pressure prevailing in the pressure chamber upon imposition of high pressure, for instance via the inlet from the common rail, can be used to reinforce the sealing force of the sealing element. If the sealing element, in accordance with the proposed invention, is shrink-fitted by nonpositive engagement by means of a press fit onto an insert part let into the injector housing of the fuel injector, then a version that is especially simple to make from a production standpoint is attained. The one-piece sealing element, preferably made from a metal material or alloys of metal materials, in particular does not tend to deform in such a way that it creeps into an annular gap between the insert part and a valve component movable into it, where it would hinder the ease of motion of the valve component inside the injector housing of the fuel injector. The sealing element that can be secured to a jacket face of the insert part by means of a press fit furthermore is a symmetrical structural part that can be produced economically.

Because of the one-piece embodiment of the sealing element, uncomplicated assembly can be attained; moreover, the sealing element that can be secured by a press fit to the jacket face of the insert part offers a sealing potential that withstands even further increases in the pressure level in the fuel injector of fuel injection systems, so that even as pressures increase further, the sealing of the high-pressure region of the pressure chamber at the fuel injector is still assured.

The sealing of the high-pressure region of the fuel injector is preferably accomplished with a press fit between the inside diameter of the sealing element and the valve element/tappet/nozzle needle outside diameter, the diameter differences preferably being between 0.04 and 0.15 mm.

BRIEF DESCRIPTION OF THE DRAWINGS

The invention will be described in further detail below in conjunction with the drawings, in which.

DESCRIPTION OF THE PREFERRED EMBODIMENTS

Figure 1:
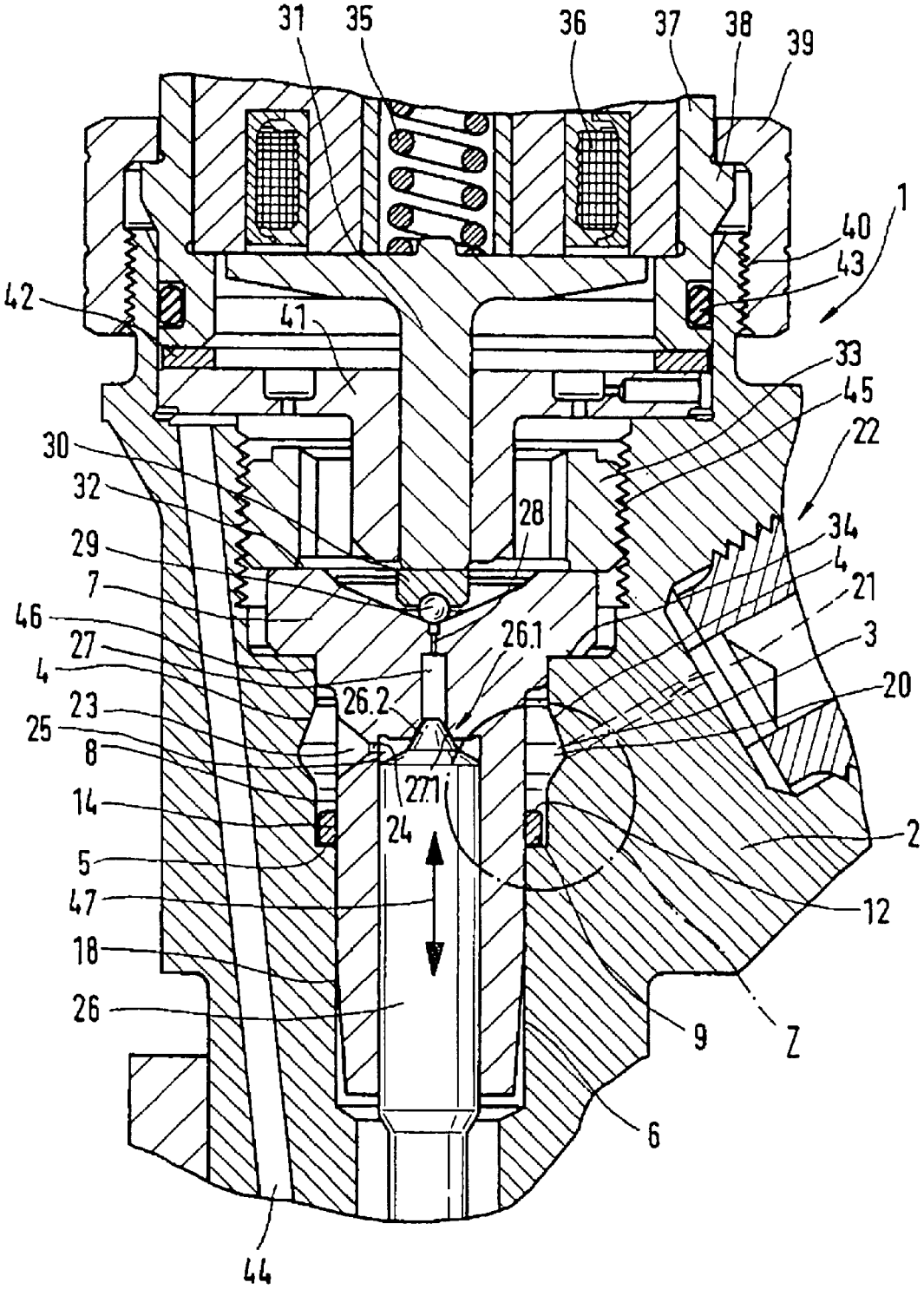
FIG. 1, is a longitudinal section through the components of a fuel injector and of the injector housing.

FIG. 1 shows a longitudinal section through the components of a fuel injector and of the injector housing.

From the view in FIG. 1 it can be seen that a fuel injector 1 used in a fuel injection system for injecting fuel includes an injector housing 2. The injector housing 2 contains a pressure chamber 3, from whose bottom 5 a bore 6 extends through the injector housing 2. The bore 6 is penetrated by a rotationally symmetrically embodied insert part 7. The insert part 7 can change over, in the course of its axial length, from a cylindrical cross section to a frustoconically tapered section. Between the circumference 8 of the insert part 7 and the wall of the bore 6 is an annular gap 18, which is required for reasons of assembly. An injection valve member 26, embodied for instance as a valve piston shown in FIG. 1, is received inside the insert part 7 and as represented by the double arrow 47 in FIG. 1 executes a vertical stroke motion for opening/closing injection openings, not shown in FIG. 1, on the end of the fuel injector 1 toward the combustion chamber.

The pressure chamber 3 embodied in the interior of the injector housing 2 is defined not only by the pressure chamber bottom 5 but also by the wall 4 of the injector housing 2. The pressure chamber 3, via a high-pressure inlet 21, shown in dashed lines, that opens into the pressure chamber 3 at an orifice point 20, communicates with the high-pressure connection 22 of the high-pressure source. The orifice point 20 of the high-pressure inlet 21 is preferably located at a point in the wall 4 of the pressure chamber 3 in the interior of the injector housing 2 that is optimized in terms of strength.

A sealing element 9 is received on the circumference 8 of the insert part 7 and is pressed by the high pressure prevailing in the pressure chamber 3 against the pressure chamber bottom 5 that forms a supporting surface 17. The high pressure prevailing in the pressure chamber 3 acts upon the one-piece sealing element 9 at its first annular face 12, which represents the hydraulic face that is effective for the hydraulic pressing force applied. The sealing element 9 is preferably embodied in one piece and is of annular shape. The one-piece sealing element 9 is received on the circumference 8 of the insert part 7 by means of a nonpositive connection 14, such as a press fit. The press fit 14 is effected by differences between the inside diameter of the one-piece sealing element 9 and the outside diameter of the insert part 7, and these differences can amount to between 0.04 and 0.15 mm. The one-piece annular element, which preferably comprises metal material or an alloy of materials, can be shrink-fitted onto the circumference 8 of the insert part 7 for that purpose. The one-piece sealing element 9 can for instance comprise aluminum or an aluminum alloy. A nonpositive connection in the form of a press fit 14 can be made between the circumferential surface 8 of the insert part 7 and the inside diameter of the one-piece sealing element 9 of metal material, by means of cold-pressing of the metal sealing element 9 onto the circumferential surface 8 of the insert part 7. Depending on the differences in diameter of the parts 7 and 9 that are to be joined together by the non positive connection 14, a corresponding radial force is established, which determines the strength of the press fit 14 between the insert part 7 and the one-piece sealing element 9. The sealing element 9 has a first annular face 12. which points toward the pressure chamber 3, and a further, second annular face, pointing toward the pressure chamber bottom 5. When the second annular face 13 of the sealing element 9 of metal material is in sealing contact with the bottom face 5 of the pressure chamber, the pressure chamber bottom acts as a supporting surface 17, which sealingly closes an annular gap 18 that is required for assembly reasons between the circumferential surface 8 of the insert part 7 and the bore 6 inside the injector housing 2. The sealing action of the sealing element 9 is enhanced by the fuel pressure applied in the pressure chamber 3, since the pressure prevailing in the pressure chamber 3 urges the sealing element 9 in the direction 19 (see the view in FIG. 2), in the direction of the pressure chamber bottom 5 of the pressure chamber. Because a metal material or an alloy of metal materials is used in producing the sealing element, deformation thereof is precluded. This prevents the sealing element 9, over increasingly long operation of the fuel injector 1, from creeping into the annular gap 18 between the circumferential surface 8 of the insert part 7 and the bore 6 inside the injector housing 2 and causing leaks to occur. Besides the avoidance of leaks, when the sealing element 9 proposed according to the invention, made from a metal material or alloys of metal materials, is used, leakage losses from the pressure chamber 3 that are subjected to high pressure are also limited.

From the pressure chamber 3, the fuel that is at very high pressure and is flowing in via the high-pressure inlet 21 passes through an inlet funnel 23 and an inlet throttle 24, adjoining it, in the wall of the insert part 7 to enter a control chamber 25. The control chamber 25 is defined on one side by the insert part 7 and on the other by a valve component 26, guided in the insert part, that can for instance be embodied as a valve piston. The end face of the valve component 26 can have a contour 26.1. Thus a frustoconical region 26.2 can be embodied on the end face of the valve component 26; this region cooperates with a conical region 27.1 of complementary shape at the outlet 27 on the outlet side of the control chamber 25. An outlet 27 in which an outlet throttle 28 is received extends away from the control chamber 25.

The outlet throttle 28, by way of which, upon actuation of a closing element 29, embodied here as a ball body, a pressure relief of the control chamber 25 is brought about, is disposed at the end of the outlet 27. The closing element 29 that opens and closes the outlet throttle 28 is partly surrounded by a shaped body 30, which is disposed on a lower face end of an armature part 31 of a magnet assembly for actuating the fuel injector 1.

In the view in FIG. 1, the armature part 31 is embodied in one piece and includes both a bolt part and a part configured in platelike fashion.

The insert part 7, which can have an upper, cylindrical part and adjoining it a conically tapering part that defines an annular gap 18, is fixed in a stepped bore 6, 46 in the injector housing 2 by means of a fastening element 33 in the form of a lock nut. The fastening element 33 is screwed into a female thread 45 in the injector housing 2 and contacts an upper face end 32 of the insert part 7. As a result, with an annular extension that brings about a seal 34, the insert part 7 is positioned against the injector housing 2 above a bore portion 46, so that in the interior of the injector housing 2, the pressure chamber 3 is closed in pressuretight fashion in the direction of the magnet valve actuating device.

The armature part 31 of the actuating device, which armature part is embodied in one piece in the view shown in FIG. 1, is acted upon by a spring element 35, which is guided in a sleeve. The sleeve surrounding the spring element 35 is surrounded by a magnet coil 36, which in turn can be received in a magnet sleeve 37. An annularly extending protrusion 38 is embodied on the outer circumferential surface of the magnet sleeve 37, and a union nut 39 rests on it. The magnet sleeve 37 is retained by screwing the union nut 39 onto a male thread 40 on the outside of the injector housing 2 of the fuel injector 1.

The one-piece armature part 31 of the actuating device is guided partway in an insert sleeve 41, which is fixed via the magnet sleeve 37 with the interposition of a spacer ring 42, and the magnet sleeve is secured in turn to the male thread 40 of the injector housing 2 via the union nut 39. A sealing element 43, which can be made in the form of an O-ring of elastic material, is placed between the magnet sleeve 38 and the injector housing 2, which are joined to one another via the union nut 39.

In the injector housing 2 of the fuel injector shown in FIG. 1, a bore 44 is embodied, which communicates fluidically, via a communication not shown here, with the high-pressure connection 22 of the high-pressure source of the fuel injector 1, and which subjects a nozzle chamber, also not shown in FIG. 1, that surrounds an injection valve member, also not shown, to fuel that is at high pressure. The injection valve member, which may be embodied as a nozzle needle with a seat toward the combustion chamber, is actuated by a pressure relief of the control chamber 25, which chamber is defined on one side by the insert part 7, secured in the injector housing 2 by means of the fastening screw 33, and on the other by the valve component 26. The pressure relief of the control chamber 25 and its subjection to pressure are effected by actuation of the magnet valve assembly, for instance by supplying current to the magnet coil 36.

Figure 2:
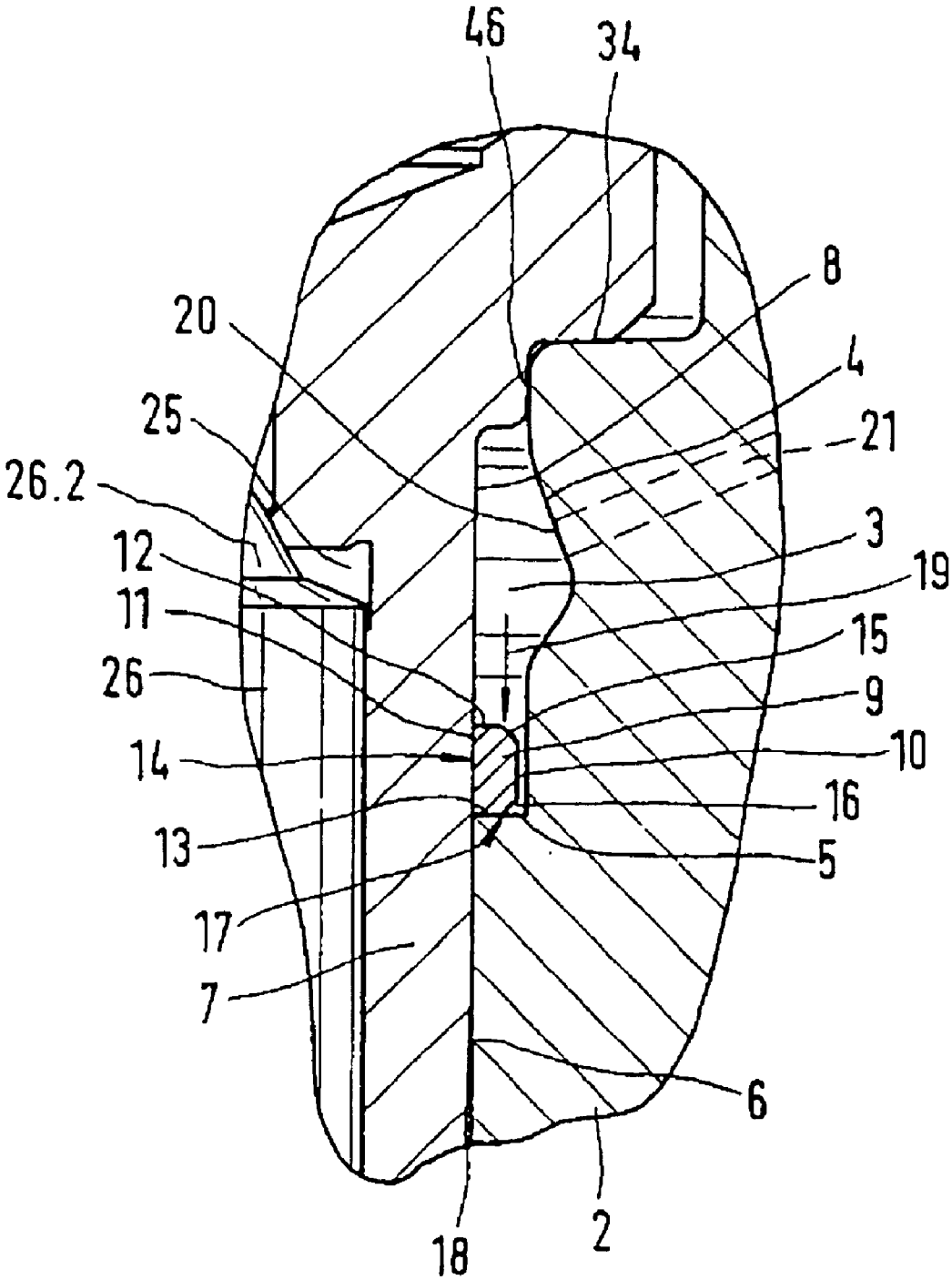
FIG. 2, an illustration of the detail Z in FIG. 1 on a larger scale.

From the view shown in FIG. 2 of the region marked Z in FIG. 1, it can be seen that the pressure chamber 3 is defined in the injector housing 2 by a wall 4, which in the region of the orifice point 20 of the high-pressure inlet 21 has a radial widening of its diameter. The orifice point 20 of the high-pressure inlet 21 from the high-pressure connection 22 not shown in FIG. 2 is preferably located in a region of the defining wall 4 of the pressure chamber 3 that is optimized in terms of pressure strength.

The sealing element 9 is secured to the circumference 8 of the insert part 7, the insert part being fixed in the injector housing 2 by means of the fastening screw 33, by means of a nonpositive connection 14 in the form of a press fit. The sealing element 9, which is preferably made from a metal material or alloys of metal materials, points with a first annular face 12 toward the pressure chamber 3, while the second annular face 13 rests on the bottom 5 of pressure chamber 3, which functions as a supporting surface 17 for the sealing element 9. Because of the high pressure prevailing in the pressure chamber 3 via the high-pressure inlet 21, the first annular face 12 of the sealing element 9 is acted upon by the pressure 19 inside the pressure chamber 3. This subjection of the sealing element 9 to pressure causes the sealing element 9, made of metal materials or alloys of metal materials, to be pressed against the pressure chamber bottom 5; that is, this is favorable for increasing the sealing force between the insert part 7 and the injector housing 2. The outside diameter of the sealing element 9 is identified by reference numeral 10, while the inside diameter 11, which together with the outside diameter of the insert part 7 brings about the nonpositive connection 14 in the form of a press fit, is located opposite the outside diameter 10. Chamfers 15 and 16 can be embodied on the preferably annularly embodied sealing element 9 for sealing off the annular gap 18 between the insert part 7 and the bore 6 inside the injector housing 2.

While the sealing of the pressure chamber 3 off from the annular gap 18 between the insert part 7 and the bore 6 inside the injector housing 2 is effected via the sealing element 9 made of metal material or alloys of metal materials, the sealing of the pressure chamber 3 on its top is achieved by means of the contact of the insert part 7 with the injector housing 2 at the contact face 34. In the view shown in FIG. 1, the insert part 7 is fixed inside the injector housing 2 in a bore 6, 46 embodied in stepped fashion, by means of a fastening screw 33. The male thread of the fastening screw 33 cooperates with a female thread 45, embodied in the interior of the injector housing 2, so that the insert part 7 can be fixed in the injector housing 2 with a defined prestressing force. By this means, sealing off of the upper region of the pressure chamber 3, which changes over into the bore portion 46 of the stepped bore 6, 46, is achieved.

In the view in FIG. 2, which shows the region marked Z in FIG. 1 on a larger scale, it can also be seen that the valve component 26, whose face end defines the control chamber 25 inside the insert part 7, can be shaped in such a way that the face end of the valve component 26 has a frustoconical region 26.2, which protrudes inward with an outlet conduit cone 27.1, embodied of complementary shape, of the outlet 27. One or more annular grooves, as shown in FIG. 2, can be embodied on the outer circumferential surface of the valve component 26.

The embodiment described in detail in conjunction with FIGS. 1 and 2 obviates targeted adaptations in terms of a possible pressure buildup below the sealing ring for later generations of fuel injectors, in which higher pressures may be realized. With the embodiment according to the invention, it is possible to preclude upward creepage of the sealing element 9 and, by a suitable choice of material, to prevent the extrusion of the sealing element 9 into the gap 18. The embodiment proposed according to the invention also offers a one-piece, economical, easily installed, symmetrical sealing element 9. To enhance the sealing action of the sealing element 9, the sealing element is advantageously disposed in such a way that it is acted upon by the high fuel pressure prevailing in the pressure chamber 3, which along with the embodiment of the nonpositive connection 14 on the circumference of the insert part 7 rises to increase the sealing force in the region of the pressure chamber bottom 5 that forms the supporting surface 17 for the sealing element 9.

The foregoing relates to preferred exemplary embodiments of the invention, it being understood that other variants and embodiments thereof are possible within the spirit and scope of the invention, the latter being defined by the appended claims.

What is claimed is:

1. In an injector for injecting fuel into the combustion chamber of an internal combustion engine, having an injector housing (2), in which a pressure chamber (3) surrounding an insert part (7) is embodied that can be filled with fuel at high pressure via a high-pressure inlet (21) and by way of which a control chamber (25) can be subjected to pressure, the control chamber being defined by the insert part (7), fixed in the injector housing (2) in a bore (6, 46), and by a valve component (26), which valve component (26) executes a stroke motion (47) inside the insert part (7), the improvement comprising a one-piece, metal sealing element (9) received on the circumference (8) of the insert part (7) by a nonpositive connection (14), the sealing element (9) being subjected to the high pressure prevailing in the pressure chamber (3), wherein the sealing element (9) is designed annularly and has a first annular face (12), which points toward the pressure chamber (3) and has a second annular face (13) facing that chamber, which second annular face points toward the bottom (5) of the pressure chamber (3), acting as a supporting surface (17).

2. The injector of claim 1, wherein when the second annular face (13) of the one-piece sealing element (9) is resting on the pressure chamber bottom (5) of the pressure chamber (3), an annular gap (18) between the insert part (7) and the bore (6) inside the injector housing (2) is closed.

3. The injector of claim 1, wherein the sealing element (9) is made from an alloy of metal materials.

4. The injector of claim 1, wherein the sealing element (9) is made as an aluminum ring.

5. The injector of claim 1, wherein the one-piece sealing element (9) is received on the circumference of the insert part (7) by means of a press fit (14).

6. The injector of claim 5, wherein the diameter differences between the inside diameter (11) of the sealing element (9) and the outside diameter of the insert part (7) are between 0.04 and 0.15 mm.

7. In an injector for injecting fuel into the combustion chamber of an internal combustion engine, having an injector housing (2), in which a pressure chamber (3) surrounding an insert part (7) is embodied that can be filled with fuel at high pressure via a high-pressure inlet (21) and by way of which a control chamber (25) can be subjected to pressure, the control chamber being defined by the insert part (7), fixed in the injector housing (2) in a bore (6, 46), and by a valve component (26), which valve component (26) executes a stroke motion (47) inside the insert part (7), the improvement comprising a one-piece, metal sealing element (9) received on the circumference (8) of the insert part (7) by a nonpositive connection (14), the sealing element (9) being subjected to the high pressure prevailing in the pressure chamber (3), wherein the pressure chamber (3) embodied in the injector housing (2) is sealed off in its upper region by a sealing point (34), formed between an annular face of the insert part (7) and a boundary face of a bore portion (46), the sealing force of which sealing point is defined via a fastening element (33) that can be received in the injector housing (2).

8. The injector of claim 1, wherein the pressure chamber (3) is defined by a wall (4) inside the injector housing (2) that has a portion of widened diameter within which an orifice point (20) of a high-pressure inlet (21) is located.

9. The injector of claim 7, wherein the sealing element (9) is made from an alloy of metal materials.

10. The injector of claim 7, wherein the sealing element (9) is made as an aluminum ring.

11. The injector of claim 7, wherein the one-piece sealing element (9) is received on the circumference of the insert part (7) by means of a press fit (14).

12. The injector of claim 11, wherein the diameter differences between the inside diameter (11) of the sealing element (9) and the outside diameter of the insert part (7) are between 0.04 and 0.15 mm.

13. The injector of claim 7, wherein the pressure chamber (3) is defined by a wall (4) inside the injector housing (2) that has a portion of widened diameter within which an orifice point (20) of a high-pressure inlet (21) is located.

* * * * *

UNITED STATES PATENT AND TRADEMARK OFFICE

CERTIFICATE OF CORRECTION

PATENT NO. : 6,845,756 B2
DATED : January 25, 2005
INVENTOR(S) : Siegfried Ruthardt et al.

It is certified that error appears in the above-identified patent and that said Letters Patent is hereby corrected as shown below:

Title page,
Item [75], Inventors, third inventor should read as follows:
-- Wolfgang Ballerstedt, Schoenebeck (DE) --.

Signed and Sealed this

Twenty-seventh Day of September, 2005

JON W. DUDAS
*Director of the United States Patent and Trademark Office*